US006168339B1

(12) United States Patent
To

(10) Patent No.: US 6,168,339 B1
(45) Date of Patent: Jan. 2, 2001

(54) RING BINDER

(75) Inventor: Chun Yuen To, Shatin (HK)

(73) Assignee: World Wide Stationery Manufacturing Company Limited, Hong Kong (HK)

( * ) Notice: Under 35 U.S.C. 154(b), the term of this patent shall be extended for 0 days.

(21) Appl. No.: 09/164,320

(22) Filed: Oct. 1, 1998

Related U.S. Application Data

(63) Continuation of application No. 08/707,398, filed on Sep. 4, 1996, now Pat. No. 5,842,807.

(30) Foreign Application Priority Data

Sep. 4, 1995 (GB) ..... 9517993

(51) Int. Cl.[7] ..... B42F 13/20
(52) U.S. Cl. ..... 402/36; 402/26; 402/70; 402/73
(58) Field of Search ..... 402/36, 26, 70, 402/73, 38, 39–42, 75, 80 R, 502

(56) References Cited

U.S. PATENT DOCUMENTS

| | | | | |
|---|---|---|---|---|
| 3,098,490 | * | 7/1963 | Wance . | |
| 4,552,478 | * | 11/1985 | Cohen | 402/39 |
| 5,100,253 | | 3/1992 | Cooper . | |
| 5,106,223 | | 4/1992 | Kraus . | |
| 5,116,157 | * | 5/1992 | Gillum et al. | 402/38 |
| 5,160,209 | | 11/1992 | Schuessler . | |
| 5,286,128 | * | 2/1994 | Gillum | 402/34 |
| 5,755,513 | * | 5/1998 | To | 402/36 |
| 5,755,525 | * | 5/1998 | Chan | 402/38 |
| 5,810,500 | * | 9/1998 | Whaley | 402/31 |
| 5,836,709 | * | 11/1998 | Cheung | 402/38 |
| 5,842,807 | * | 12/1998 | To | 402/36 |
| 5,879,097 | * | 3/1999 | Cheng | 402/26 |
| 5,924,811 | * | 7/1999 | To et al. | 402/26 |
| 5,971,649 | * | 10/1999 | To | 402/36 |
| 6,007,266 | * | 12/1999 | Cheng et al. | 402/36 |
| 6,033,144 | * | 3/2000 | Ng et al. | 402/36 |
| 6,036,394 | * | 3/2000 | Cheng | 402/26 |

FOREIGN PATENT DOCUMENTS

| | | |
|---|---|---|
| 196 02 813 | 8/1996 | (DE) . |
| 1484908 | 9/1977 | (GB) . |

* cited by examiner

*Primary Examiner*—Willmon Fridie, Jr.
*Assistant Examiner*—Alisa L. Thurston
(74) *Attorney, Agent, or Firm*—Hall, Priddy, Myers & Vande Sande

(57) ABSTRACT

There is disclosed a ring binder adapted to be secured to a cover, the ring binder including an upper plate with a longitudinal axis; a pair of elongate plates supported by the upper plate; a number of ring members mounted to the elongate plates; and two rivets for securing the ring binder to the cover, in which each of the rivets includes a cylindrical body in direct engagement with the upper plate for attaching the rivet to the upper plate and an abutment plate adapted to abut the cover when the ring binder is secured to the cover; and a number of claws for securing the ring binder to the cover, in which the abutment plate includes a major surface, and the abutment plate includes at least one side edge from which a ridge member extends away from the major surface.

12 Claims, 3 Drawing Sheets

RING BINDER

This is a continuation of Ser. No. 08/707,398, filed Sep. 4, 1996, now U.S. Pat. No. 5,842,807.

This invention relates to a ring binder and, in particular, a ring binder adapted to be secured by at least one rivet to a base member.

Conventionally, a ring binder is securable to a cover by rivets having a head portion engageable with the cover and a tail portion which is deformable, e.g. by punching, to engage a barrel secured to an upper plate of the ring binder.

A disadvantage associated with such a conventional ring binder is that the assembling process is both laborious and prone to error. In the first place, it is necessary to provide the assemblers with rivets properly sized and shaped to fit both the barrels and the corresponding holes in the cover. The assemblers have to secure the ring binder to the cover by first inserting the rivet through the cover, then through the barrel in the ring binder and then to deform the tail of the rivet, e.g. by punching, to engage the upper plate of the ring binder.

It is therefore an object of the present invention to provide a ring binder in which the aforesaid shortcomings are mitigated. It is also a further object of the present invention to provide a rivet to mitigate the aforesaid problems.

According to a first aspect of the present invention, there is provided a ring binder adapted to be secured to a base member the ring binder including a substantially rigid integral upper structure with a longitudinal axis; a pivotable lower structure supported by said upper structure; a plurality of ring members mounted to said lower structure; and at least one integral securing means for securing said ring binder to said base member, said at least one securing means including an engagement portion in direct engagement with the upper structure for attaching said securing means to said upper structure; an abutment portion adapted to abut said base member when said ring binder is secured to said base member; and a plurality of securing elements for securing the ring binder to the base member; said abutment portion including at least one major surface; and said abutment portion including at least one side edge from which a ridge member extends away from said major surface.

According to a second aspect of the present invention, there is provided a rivet for securing a ring binder to a base member, said rivet including an engagement portion adapted to be in direct engagement with said ring binder; an abutment portion for abutting said base member when said ring binder is secured to said base member; and a plurality of securing elements for securing the ring binder to the base member; said abutment portion including at least one major surface; and said abutment portion including at least one side edge from which a ridge member extends away from said major surface.

The present invention will now be discussed in further detail and with reference to the accompanying drawings, wherein.

Figure 1:
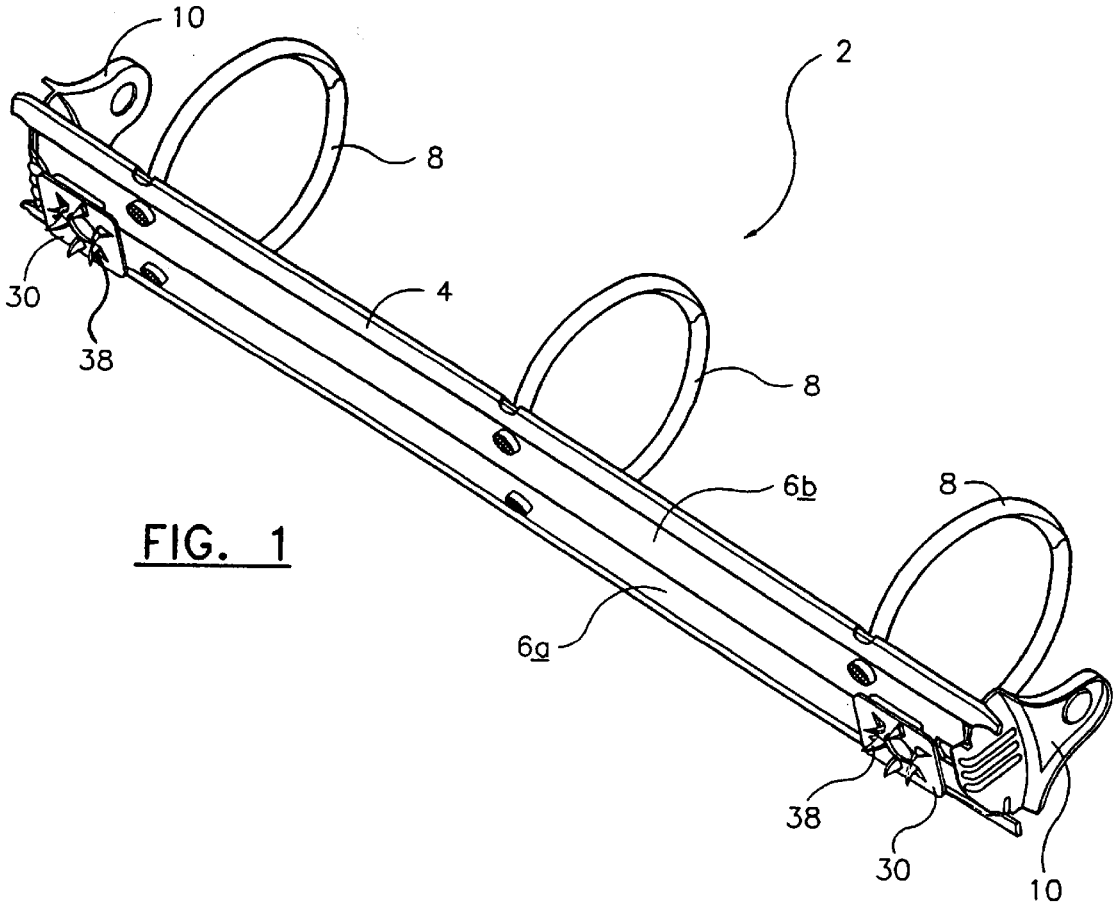
FIG. 1 shows an underside perspective view of a ring binder according to the present invention.
Figure 2:
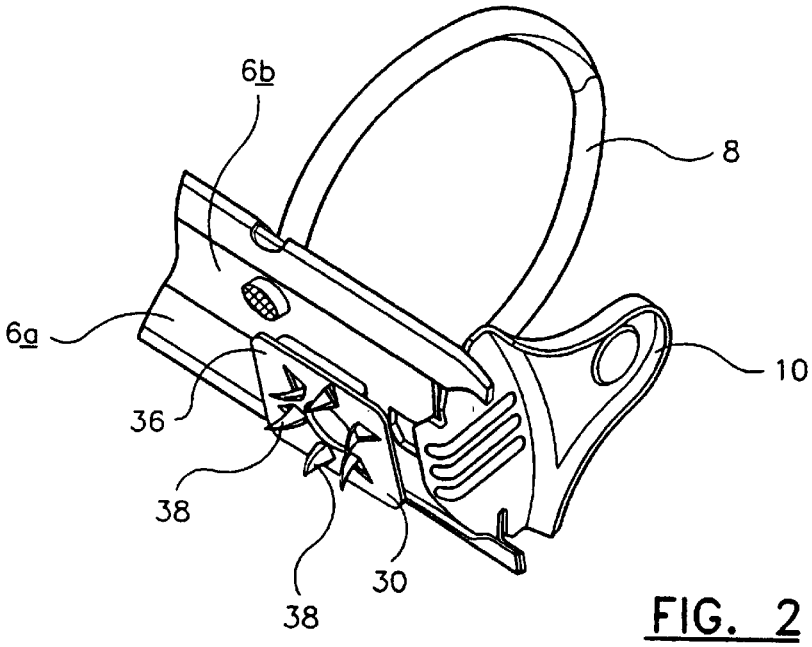
FIG. 2 shows an enlarged partial view of the ring binder shown in FIG. 1.
Figure 4:
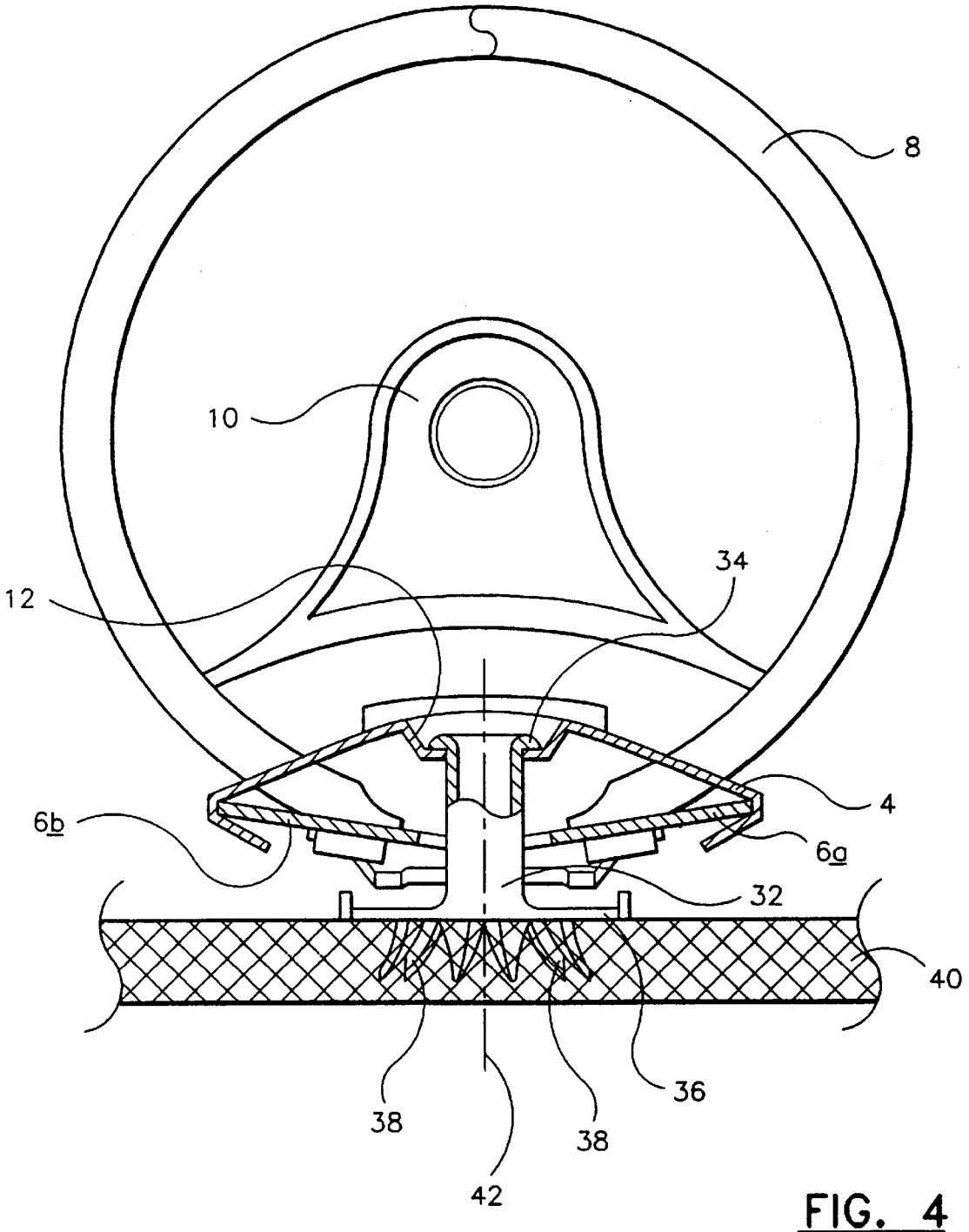
FIG. 4 shows a transverse cross-sectional view of the ring binder shown in FIG. 1.

FIGS. 1, 2 and 4 show a ring binder according to the present invention, generally designated as 2, as comprising a substantially rigid curved upper plate 4 supporting a pair of elongate plates 6*a* and 6*b* pivotally moveable relative to each other. Secured to the elongate plates 6*a* and 6*b* are three ring members 8. At each end of the ring binder 2 is a lever 10 which may be pivoted outwardly, e.g. by a thumb, to act upon the underside of the elongate plates 6*a* and 6*b* and thereby to open the ring members 8 in the conventional manner. Engageable with an open depression 12 near each end of the curved upper plate 4 is a rivet 30.

Figure 3A:
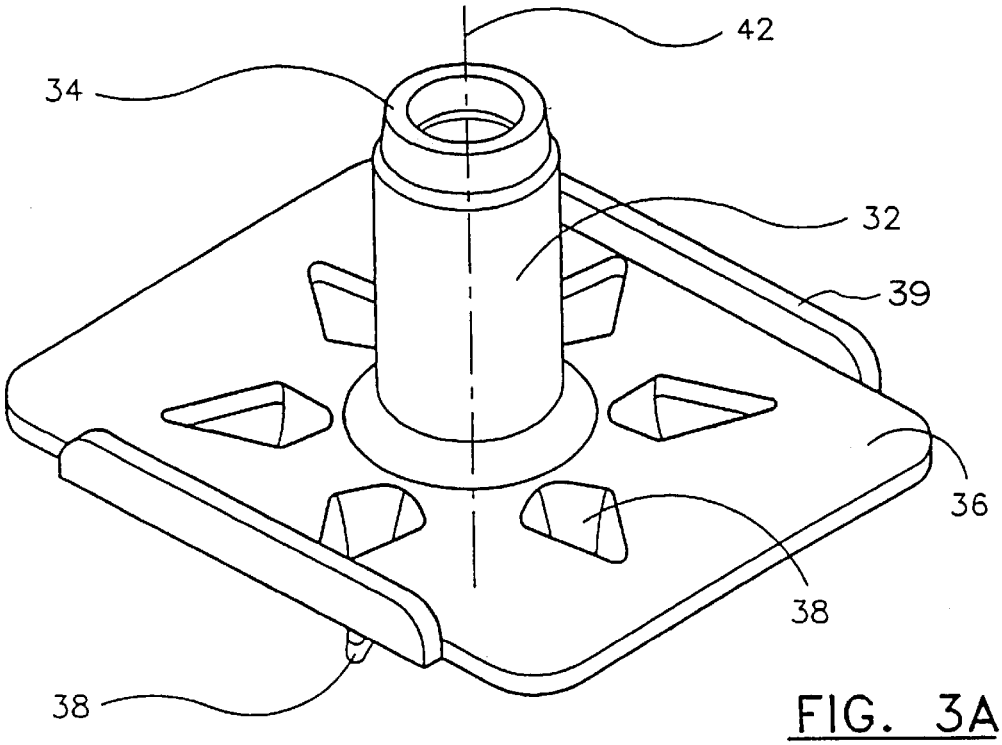
FIGS. 3A and 3B show top perspective and underside perspective views of the rivet shown in FIGS. 1 and 2.
Figure 3B:
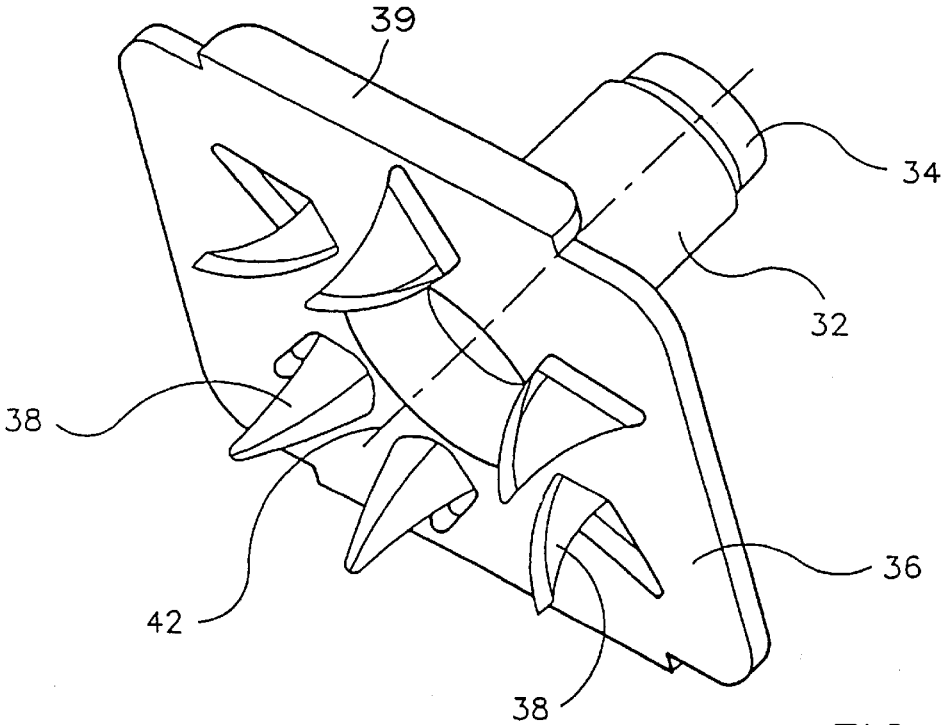

As shown more clearly in FIGS. 3A and 3B, the rivet 30 comprises a cylindrical body 32 having a narrower head 34 which is deformable to engage the depression 12. The rivet 30 has a substantially flat plate 36 with a number of downwardly depending claws 38, and at least one ridge member 39, which extends away from at least one edge of the substantially flat plate 36. The claws 38 may be deformed to engage a cardboard or plastic (e.g. PVC) cover 40. The claws 38 are formed by being pushed out from the flat plate 36. The claws 38 extend away, and are positioned equi-distantly, from the longitudinal axis 42 of the cylindrical body 32. The cylindrical body 32, head 34, flat plate 36 and claws 38 are all integrally formed, so as to enhance the strength of the rivet 30. When assembled, the flat plate 36 abuts against that surface of the cover 40 facing the ring binder 2. Such an arrangement enhances the stability of the rivet 30, hence the ring binder 2, relative to the cover 40.

It should be noted that the above only illustrates examples whereby the present invention may be carried out, and that further modifications and changes may be made to the above example without departing from the spirit of the invention.

What is claimed is:

1. A ring binder adapted to be secured to a base member, the ring binder including:

a substantially rigid integral upper structure with a longitudinal axis;

a pivotable lower structure supported by said upper structure;

a plurality of ring members mounted to said lower structure; and at least one integral securing means for securing said ring binder to said base member, said at least one securing means including an engagement portion in direct engagement with the upper structure for attaching said securing means to said upper structure;

a plurality of securing elements for securing the ring binder to the base member; and an abutment portion adapted to abut said base member when said ring binder is secured to said base member;

said abutment portion including at least one major surface; and at least one side edge from which a ridge member extends away from said major surface.

2. The ring binder of claim 1 wherein said ridge member is integrally formed with said abutment portion.

3. The ring binder of claim 1 wherein said ridge member is integrally formed with said securing elements.

4. The ring binder of claim 1 wherein said abutment portion includes at least two side edges from each of which a ridge member extends away from said major surface.

5. The ring binder of claim 4 wherein said abutment portion includes four side edges wherein a respective ridge member extends from two opposite and substantially parallel side edges.

6. The ring binder of claim 1 wherein the length of said ridge member extends substantially parallel to the longitudinal axis of said upper structure.

7. A rivet for securing a ring binder to a base member, said rivet including:

an engagement portion adapted to be in direct engagement said ring binder;

a plurality of securing elements for securing the ring binder to the base member; and an abutment portion for abutting said base member when said ring binder is secured to said base member;

said abutment portion including at least one major surface; and at least one side edge from which a ridge member extends away from said major surface.

8. The rivet of claim 7 wherein said ridge member is integrally formed with said abutment portion.

9. The rivet of claim 7 wherein said ridge member is integrally formed with said securing elements.

10. The ring binder of claim 7 wherein said abutment portion includes at least two side edges from each of which a ridge member extends away from said major surface.

11. The ring binder of claim 10 wherein said abutment portion includes four side edges wherein a respective ridge member extends from two opposite and substantially parallel side edges.

12. The ring binder of claim 7 wherein the length of said ridge member extends substantially parallel to the longitudinal axis of said upper structure when said rivet is engaged with said ring binder.

* * * * *